US010215130B2

(12) United States Patent
Visuri et al.

(10) Patent No.: US 10,215,130 B2
(45) Date of Patent: Feb. 26, 2019

(54) CHOKE OVERRIDE FOR AN ENGINE

(75) Inventors: Michael R. Visuri, Brown Deer, WI (US); Jeff J. Steenbergen, Watertown, WI (US); Timothy J. Kwiatkowski, Muskego, WI (US); Adam J. Hellman, Bayside, WI (US); Andrew J. Perez, Brookfield, WI (US); Casey E. Groh, Shorewood, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 382 days.

(21) Appl. No.: 13/371,051

(22) Filed: Feb. 10, 2012

(65) Prior Publication Data

US 2013/0206093 A1 Aug. 15, 2013

(51) Int. Cl.

| | |
|---|---|
| ***F02M 1/02*** | (2006.01) |
| ***F02M 1/12*** | (2006.01) |
| ***F02M 7/22*** | (2006.01) |
| ***F02M 1/00*** | (2006.01) |
| ***F02M 1/08*** | (2006.01) |
| ***F02M 1/10*** | (2006.01) |
| *F02D 9/02* | (2006.01) |

(52) U.S. Cl.

CPC ..... *F02M 1/02* (2013.01); *F02M 1/00* (2013.01); *F02M 1/08* (2013.01); *F02M 1/10* (2013.01); *F02M 1/12* (2013.01); *F02M 7/22* (2013.01); *F02D 2009/0205* (2013.01)

(58) Field of Classification Search

CPC ..... F02M 1/08–1/10; F02M 1/02; F02D 2009/0205

USPC ..... 123/179.3, 437, 583, 592, 391; 261/39.1–39.4, 64.6; 251/294

See application file for complete search history.

(56) References Cited

U.S. PATENT DOCUMENTS 1,139,851 A * 5/1915 Dayton ..... F02M 1/02 261/52
1,334,555 A * 3/1920 Robbins ..... G05D 13/00 123/320
1,851,711 A * 3/1932 Linga ..... F02M 1/02 261/41.5
RE18,731 E * 2/1933 Weatherhead, Jr. ..... B60R 16/005 200/4

(Continued)

FOREIGN PATENT DOCUMENTS

GB 141443 A * 4/1920 ..... F02M 1/02
GB 186 716 A * 10/1922
GB 186716 A * 10/1922 ..... F02M 1/02

*Primary Examiner* — Mahmoud Gimie
*Assistant Examiner* — Josh Campbell
(74) *Attorney, Agent, or Firm* — Foley & Lardner LLP

(57) ABSTRACT

A choke system for an internal combustion engine includes a carburetor having a choke valve disposed in a passage; a cooling fan providing a variable air flow; an air vane moveable in response to the variable air flow; an air vane linkage coupling the air vane to the choke valve, the air vane linkage operating the choke valve by the movement of the air vane; a manually operated choke control; an override linkage coupling the choke control to the choke valve; and a thermally responsive member configured to engage the override linkage to retain the choke in a partially open position above a threshold temperature. The choke control may be moved to a first position in which the choke control overrides the thermally responsive member and the air vane linkage to maintain the choke valve in a closed position.

15 Claims, 8 Drawing Sheets

(56) References Cited

U.S. PATENT DOCUMENTS 2,017,239 A 10/1935 Gerald
2,127,653 A * 8/1938 Sisson ..... F02M 1/10 123/179.16
2,548,334 A * 4/1951 Armstrong ..... 261/39.1
2,695,033 A * 11/1954 Campbell ..... F02M 1/14 137/481
2,737,825 A * 3/1956 Plockelman ..... F02M 1/02 137/269
2,764,393 A * 9/1956 Geyer ..... 261/64.6
2,783,984 A 3/1957 Kramer
2,908,263 A 10/1959 Brown
2,935,977 A * 5/1960 Eberline ..... 123/198 DC
2,979,047 A * 4/1961 Rapplean et al. ..... 261/38
3,064,953 A * 11/1962 Hayes ..... 261/39.3
3,118,433 A 1/1964 Lechtenberg
3,161,186 A 12/1964 Reichenbach et al.
3,194,224 A 7/1965 Lechtenberg et al.
3,199,530 A 8/1965 Svendsen
3,305,223 A * 2/1967 Reichenbach ..... 261/52
3,321,194 A 5/1967 Carlson
3,328,011 A 6/1967 Winkler et al.
3,807,709 A 4/1974 Suda et al.
3,823,700 A 7/1974 Gumtow
3,863,614 A 2/1975 Thompson et al.
3,868,935 A 3/1975 Liebman et al.
4,031,872 A 6/1977 Thompson et al.
4,068,636 A 1/1978 Nau et al.
4,151,499 A * 4/1979 Ganowsky ..... H01F 7/145 261/39.3
4,254,064 A * 3/1981 Bernauer et al. ..... 261/64.6
4,450,117 A 5/1984 Nakamura et al.
4,612,770 A 9/1986 Tadokoro et al.
4,788,014 A * 11/1988 Kanno ..... 261/39.2
4,860,608 A 8/1989 Kobayashi
4,961,409 A 10/1990 Kobayashi et al.
5,827,455 A 10/1998 Nakai
6,114,941 A * 9/2000 Scott ..... H01H 37/08 116/206
6,116,581 A 9/2000 Watanabe et al.
6,145,487 A 11/2000 Dykstra et al.
6,202,989 B1 * 3/2001 Pattullo ..... 261/52
6,752,110 B2 6/2004 Tharman et al.
6,990,969 B2 * 1/2006 Roth ..... F01N 1/00 123/437
7,331,326 B2 2/2008 Arai et al.
7,344,125 B2 3/2008 Matsuda et al.
7,628,387 B1 12/2009 Clouse et al.
8,783,664 B2 7/2014 Arai
9,316,175 B2 4/2016 Raasch
2005/0144919 A1 * 7/2005 Osborne ..... 56/10.8
2005/0194701 A1 9/2005 Moriyama et al.
2006/0283968 A1 * 12/2006 Reichle ..... 237/28
2008/0223336 A1 9/2008 Arai et al.
2009/0146327 A1 6/2009 Roth
2009/0293828 A1 12/2009 Iwata et al.
2009/0299614 A1 12/2009 Iwata et al.
2011/0226217 A1 9/2011 Raasch
2011/0315176 A1 12/2011 Gilpatrick
2012/0247423 A1 10/2012 Furuya
2012/0304963 A1 12/2012 Raasch
2013/0000586 A1 1/2013 Zuo et al.
2013/0276751 A1 10/2013 Raasch

* cited by examiner

CHOKE OVERRIDE FOR AN ENGINE

BACKGROUND

The present invention relates generally to the field of small, internal combustion engines, such as those engines that may be used to power outdoor power equipment including, for example, lawn mowers, snow throwers, and pressure washers. More specifically, the present invention relates to a manual choke override system for a small, internal combustion engine.

It is known to use a manually-operable starting device to assist in starting of a small internal combustion engine. Typical manual starting devices include a primer or a choke, which may be used together in some applications. A primer provides a charge of fuel before the engine is started to assist in starting, particularly at lower temperatures. A choke valve is typically positioned in the air intake passageway, and reduces the amount of intake air to thereby enrich the air/fuel mixture during engine starting.

An automatic choke system may be used to automatically engage or disengage the choke at an appropriate point to keep the engine from stumbling or stalling after it has started. Such automatic chokes may also be configured to be disengaged during hot restarts of the engine. It is desirable to disengage the choke during hot restarts to prevent stumbling or stalling of the engine when the engine is already warmed up. However, in cold climates, such an automatic choke may disengage too quickly, causing the air/fuel mixture to lean out prematurely.

SUMMARY

One embodiment of the invention relates a choke system for an internal combustion engine. The internal combustion engine includes a carburetor with a choke valve; an automatic choke mechanism coupled to choke valve; and a manual choke override. The manual choke override includes a manually operated choke control and an override linkage coupling the choke control to the choke valve. The choke control includes a single throttle lever having a throttle range and a choke position; and a structure to prevent the inadvertent positioning of the throttle lever in the choke position. Positioning the throttle lever in the choke position operates the override linkage to override the automatic choke mechanism and close the choke valve.

Another embodiment relates to a choke system for use with equipment powered by an internal combustion engine. The choke system includes a carburetor having a passage and a choke valve disposed in the passage. The choke system further includes a cooling fan providing a variable air flow; an air vane moveable in response to the variable air flow; and an air vane linkage coupling the air vane to the choke valve, the air vane linkage operating the choke valve by the movement of the air vane. The choke system further includes a manually operated choke control; an override linkage coupling the choke control to the choke valve; and a thermally responsive member configured to engage the override linkage to retain the choke in a partially open position above a threshold temperature. The choke control may be moved to a first position in which the choke control overrides the thermally responsive member and the air vane linkage to maintain the choke valve in a closed position.

Still another embodiment relates to an engine for enhanced cold weather operation. The engine includes a carburetor including a carburetor throat and a choke valve disposed in the carburetor throat. The engine further includes a radial fan configured to create an air flow; an air vane moveable in response to the variable air flow; and an air vane linkage coupling the air vane to the choke valve, the air vane linkage operating the choke valve by the movement of the air vane. The engine further includes a manually operated choke control; an override linkage coupling the choke control to the choke valve; and a thermally responsive member configured to engage the override linkage to retain the choke in a partially open position above a threshold temperature. The manually operated choke control is utilized to override the thermally responsive member and the air vane linkage to close the choke valve for an extended period.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
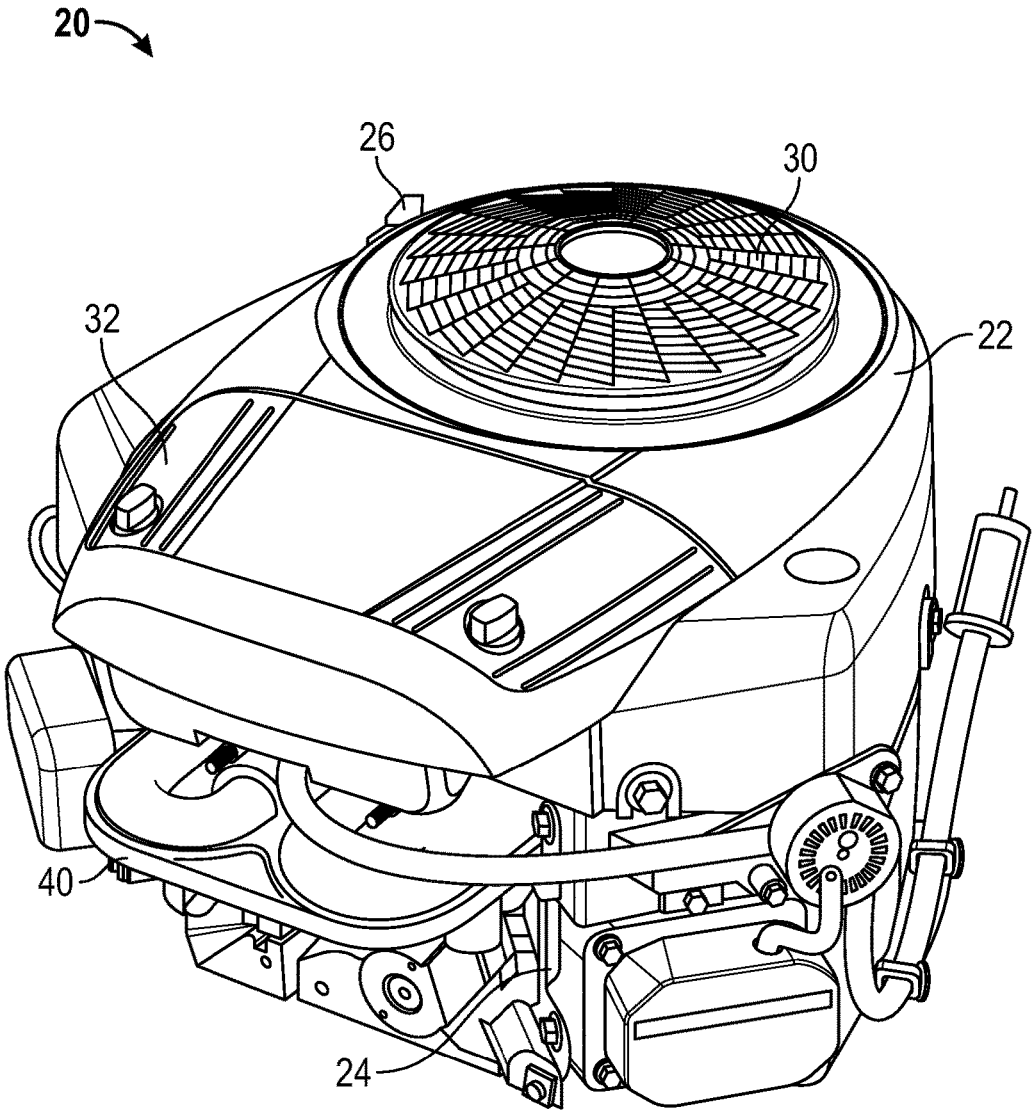
FIG. 1 is a perspective view of an internal combustion engine including a choke override, in accordance with an exemplary embodiment.

Referring to FIG. 1, in an exemplary embodiment, an engine 20 is a small, two cylinder, gasoline-powered, four-stroke cycle internal combustion engine. However a broad range of engines may benefit from the teachings disclosed herein. In some embodiments, the engine 20 is vertically shafted (as shown in FIG. 1), while in other embodiments, an engine is horizontally shafted. For example, in some contemplated embodiments, the engine may include a single cylinder, may include three or more cylinders, may be a diesel engine, or may have a two-stroke cycle. In one embodiment, the engine is configured to power a riding lawn mower. In other embodiments, the engine 20 may be configured to power a broad range of equipment, including walk behind lawn mowers, pressure washers, electric generators, snow throwers, and other equipment. In contemplated embodiments, the engine 20 may be gasoline-powered, diesel, or otherwise fueled.

Referring still to FIG. 1, the engine 20 includes a cover 22 and a cylinder head 24 that are fastened to an engine block of the engine 20. The engine 20 further includes a fuel tank with a cap, a muffler, and oil fill cap 26 for an oil fill chute directing oil poured down the oil fill chute to the crankcase (e.g., engine block). The engine further includes a fan 30 and an air cleaner 32. According to an exemplary embodiment, the engine 20 still further includes an air intake assembly 40 with a carburetor 50 (see FIG. 2).

After being drawn through the air cleaner 32, air is directed to the air intake assembly 40, where it is mixed with a fuel (e.g., gasoline, diesel, ethanol, alcohol, and the like) in the carburetor 50. The air/fuel mixture is then directed to an internal combustion chamber that may be formed from a cylinder and a piston, a plurality of pistons, a cylinder head, a valve, a plurality of valves and the like.

The air flow rate through the air cleaner and the air intake assembly may be in part governed by a controller, such as a computer, with a processor, memory, and/or stored instructions. For example, the controller may activate a super- or turbo-charger compressor fan, based upon the stored instructions (e.g., a logic module), to draw an increased air flow through the air system. Such a controller may also operate other features and components of an engine, such as a timing of valves in a combustion chamber, and the like.

Figure 2:
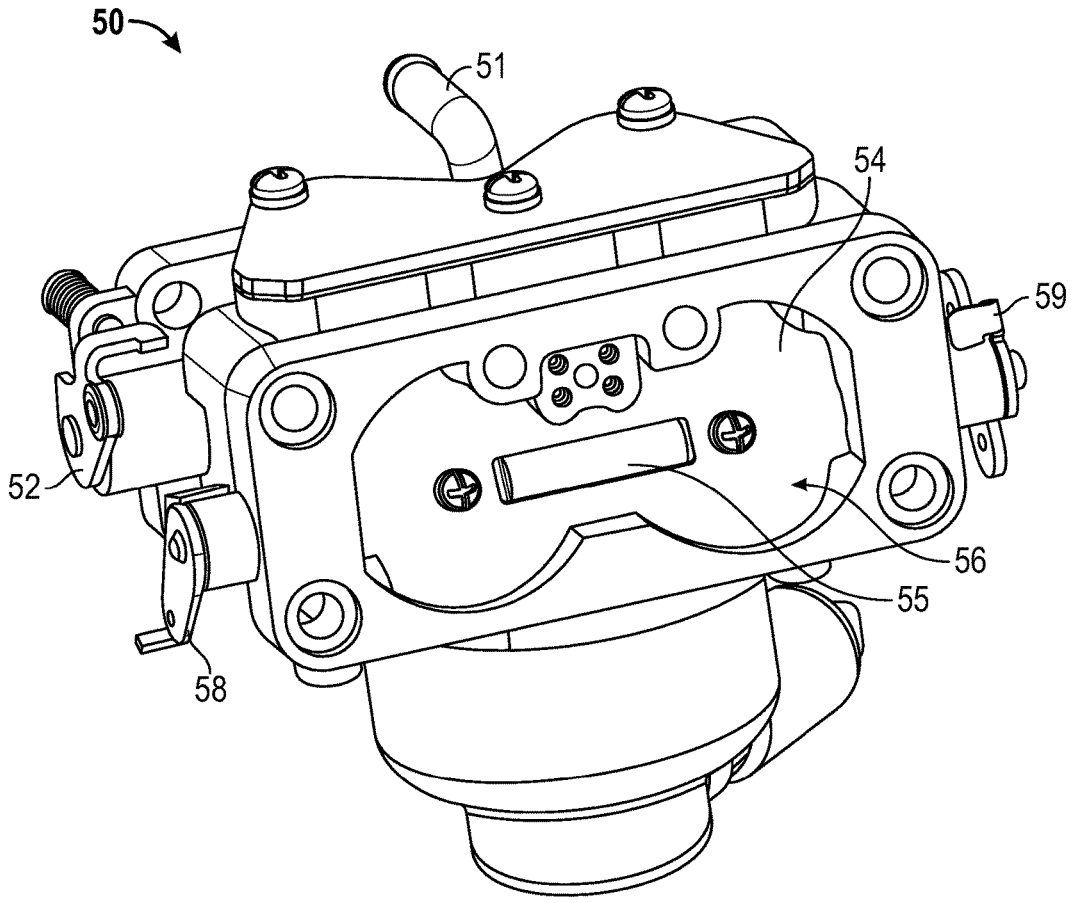
FIG. 2 is perspective view of a carburetor with a choke valve, in accordance with an exemplary embodiment.

Referring now to FIG. 2, the carburetor 50 is shown according to an exemplary embodiment. The carburetor 50 mixes fuel from a fuel input 51 with air for combustion in the engine 20. The carburetor includes a throttle valve with a throttle lever arm 52 and a choke valve 54. The choke valve 54 is a butterfly valve that rotates about a shaft 55 in an air inlet passage 56 to control the amount of air drawn into the carburetor 50 and the ratio of air to fuel mixed in the carburetor 50. As shown in FIG. 2, the choke valve shaft 55 may include a first lever 58 on one end and a second lever 59 on the opposite end. According to an exemplary embodiment, the first lever 58 is coupled to an air vane 36 (see FIG. 3) with an air vane linkage 60 and the second lever is coupled to a user interface 110 (see FIG. 11A-F) with an override linkage 70. The air vane linkage 60 and the override linkage 70 are utilized to adjust the position of the choke valve 54 to provide a preferred air-to-fuel ratio in a variety of operational conditions.

Figure 3:
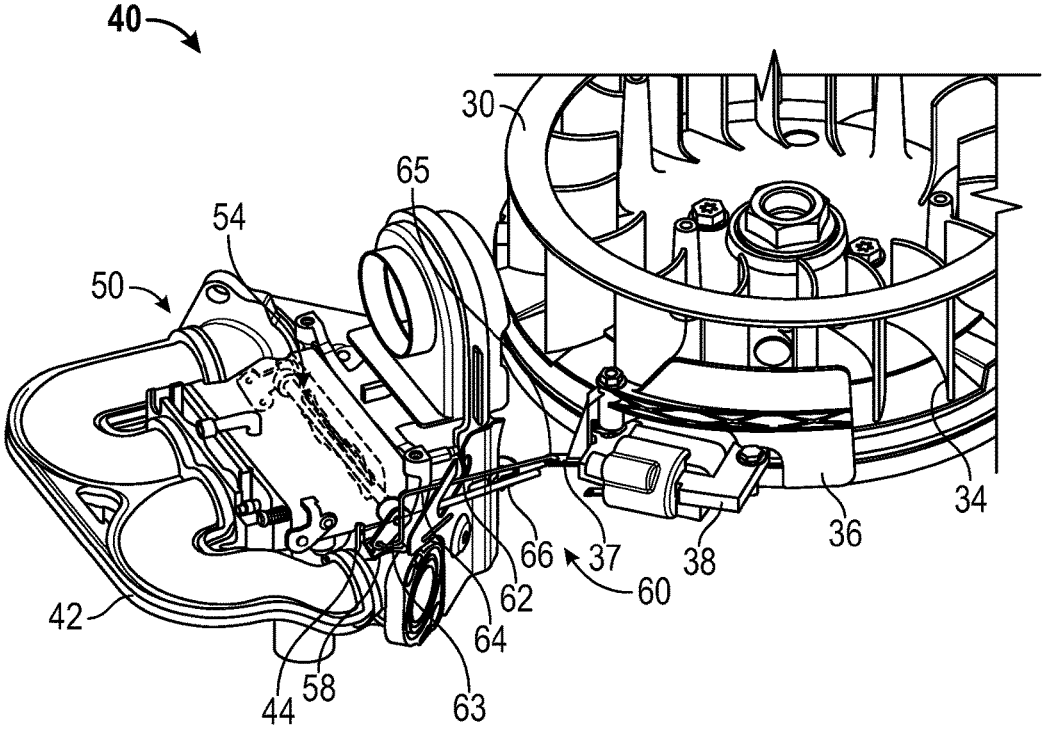
FIG. 3 is a perspective view of an air intake assembly with an auto choke system engaged, in accordance with an exemplary embodiment.
Figure 4:
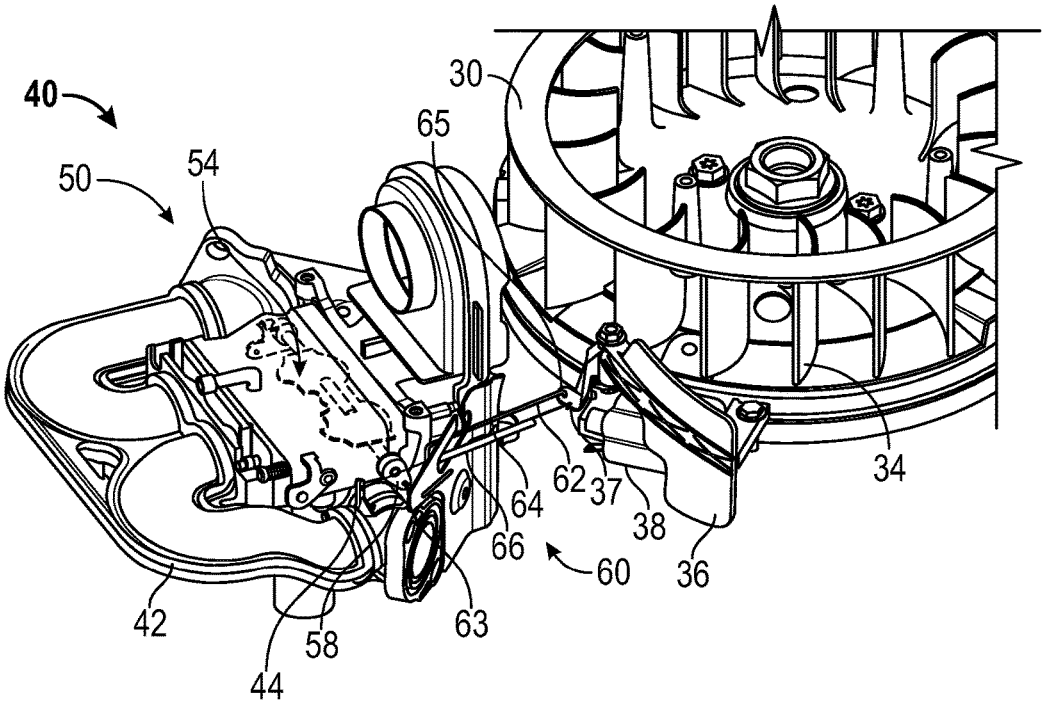
FIG. 4 is a perspective view of an air intake assembly with an auto choke system disengaged, in accordance with an exemplary embodiment.

FIGS. 3 and 4 depict the engine 20 when the engine is cold and at rest (FIG. 3) and cold and at engine operating speeds (FIG. 4). Referring to FIG. 3, the fan 30 is a radial fan coupled to the flywheel configured to direct air across the cylinder block and cylinder heads 24. The speed of the fan 30 is controlled by the speed of the engine 20 (i.e., the rotational speed of the crankshaft). In other embodiments, the fan may be separately controlled by another power source (e.g., an electric motor) and may provide a constant air flow or a variable air flow. The fan 30 includes a multitude of radially extending blades 34. An air vane 36 is pivotally mounted to a support 38 proximate to the fan 30, generally tangential to the circumference of fan 30. The air vane 36 includes a lever arm 37 which is coupled to the choke lever 58 with the air vane linkage 60 including a link arm 62 and a spring 66. The link arm 62 is a stiff, elongated member with a lengthened, straight middle portion 64 extending between the choke side 63 and the vane side 65. The choke side 63 includes a z-bend that is received in an opening in the first choke lever 58. The vane side 65 includes an angled bend to facilitate inserting the vane side into an opening in the choke lever 58. In one embodiment, the spring 66 is a tension spring that is coupled on one end to the lever arm 37 and on the opposite end to a mounting post 44 on the air intake manifold 42. The spring 66 stabilizes the motion of the link arm 62 and provides a biasing force urging the air vane 36 and the choke valve 54 into a position shown in FIG. 3. In one embodiment, the coil of the spring 66 surrounds the middle portion 64 of the link arm 62. In another embodiment, the spring 66 may be disposed next to the link arm 62. In other embodiments, the spring 66 may be another type of spring, such as a torsion spring, or another biasing mechanism.

In the embodiment of FIG. 3, when the engine 20 is at rest, there is no air flow developed by the fan 30 and the air vane 36 is therefore positioned relatively close to fan 30 by the biasing force of the spring 66. In this position, the air vane linkage 60 rotates the choke lever 58 so that choke valve 54 is at least partially closed. The choke is therefore automatically engaged (e.g., the choke valve 54 is substantially perpendicular to the passage 56, reducing the air flow into the carburetor 50) to provide a richer air/fuel mixture when the engine 20 is started.

As shown in FIG. 4, at engine operating speeds, an increased outward air flow is developed by the fan 30 as it rotates at increased speeds. The air flow overcomes the biasing force of the spring 66 and forces the air vane 36 to move radially outward. In this position, the air vane linkage 60 rotates the choke lever 58 so that choke valve 54 is at least partially open. The choke is automatically disengaged (e.g., the choke valve 54 is substantially parallel to the passage 56, no longer impeding the air flow into the carburetor 50) to provide a leaner air/fuel mixture as the engine 20 reaches operational speeds.

In other exemplary embodiments, the automatic choke system may utilize a different mechanism than an air vane. For example, the choke valve may be controlled utilizing an electrical system with a solenoid coupled to the choke valve. The solenoid may be activated utilizing signals from a variety of electronic sensors, such as a temperature sensor configured to monitor the engine temperature and an engine speed sensor. In other embodiments, the solenoid may be integrated into the starting circuit of the engine or equipment.

An override system is provided to allow a user to manually control the operation of the choke. An override system may be utilized, for example, in colder environments, in which the cold air prevents the fuel from vaporizing as readily. The choke may be engaged for an increased duration of time to allow for the carburetor 50 a richer air/fuel mixture for a longer time until the engine 20 has warmed up. The override system includes an override linkage 70 coupling the choke valve 54 to a user interface 110 (see FIG. 11A-11F). According to an exemplary embodiment, the override linkage 70 utilizes the throttle linkage of the engine 20. In other embodiments, the choke override system may utilize a separate linkage.

Figure 5:
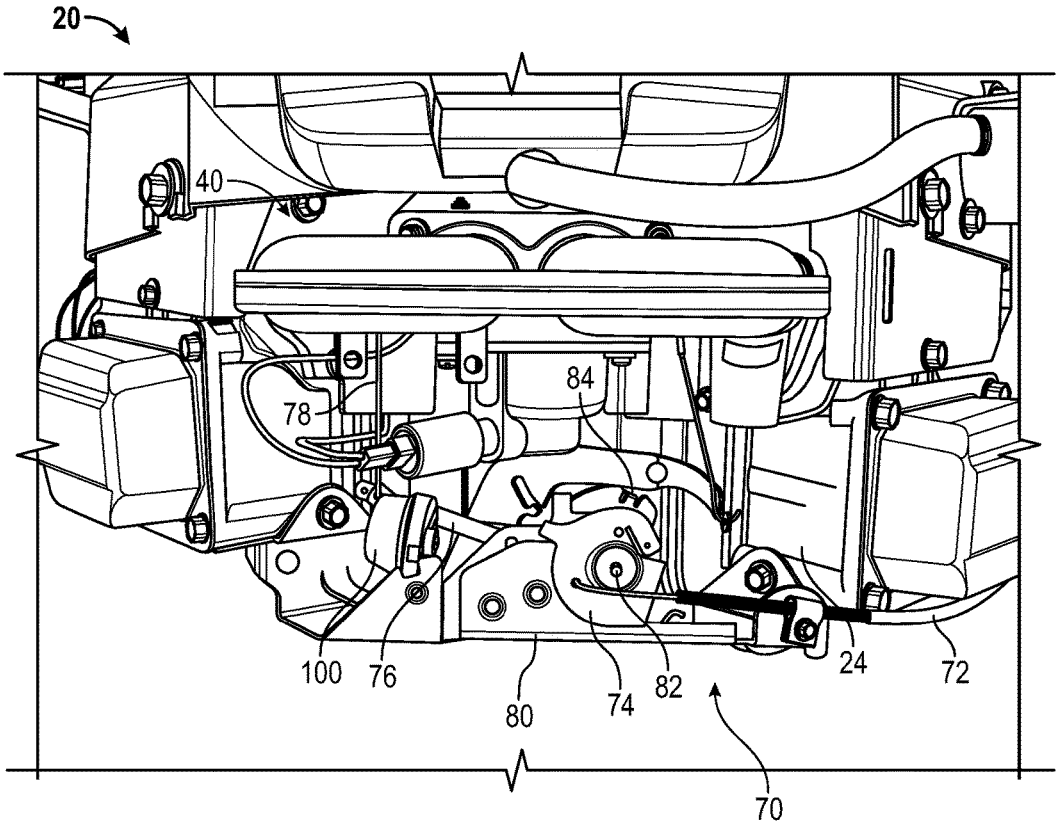
FIG. 5 is a perspective view of an override linkage for an air intake assembly, in accordance with an exemplary embodiment.
Figure 6:
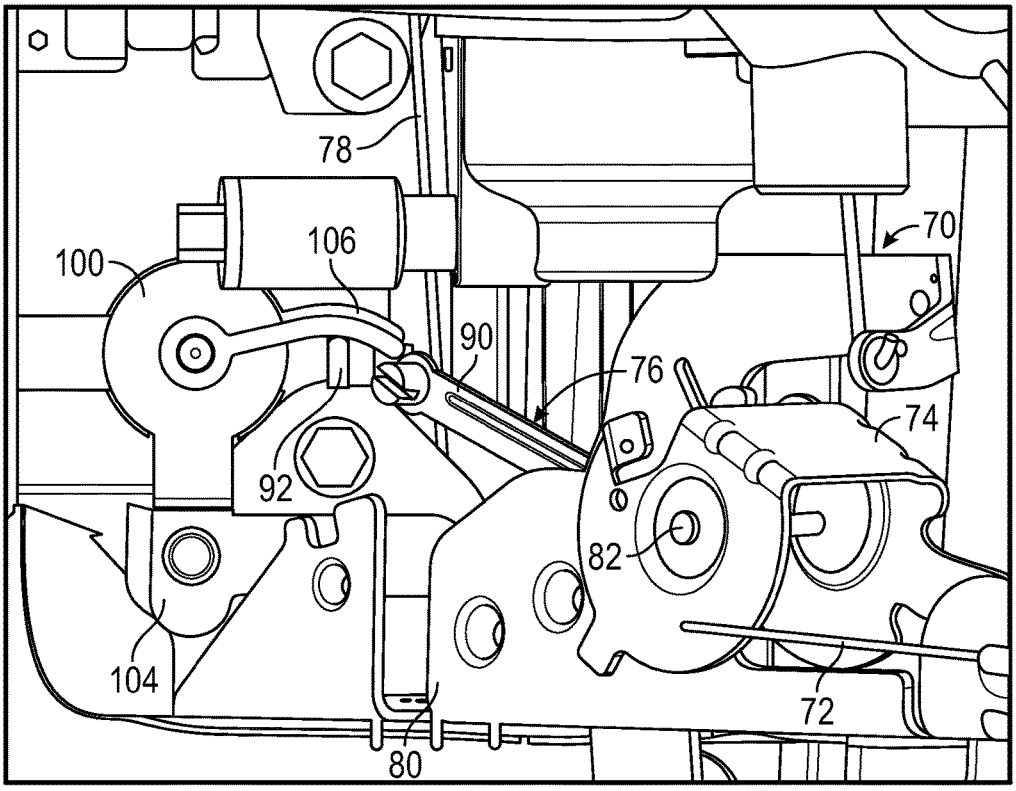
FIG. 6 is a front view of the override linkage for an air intake assembly, in accordance with another exemplary embodiment.
Figure 7:
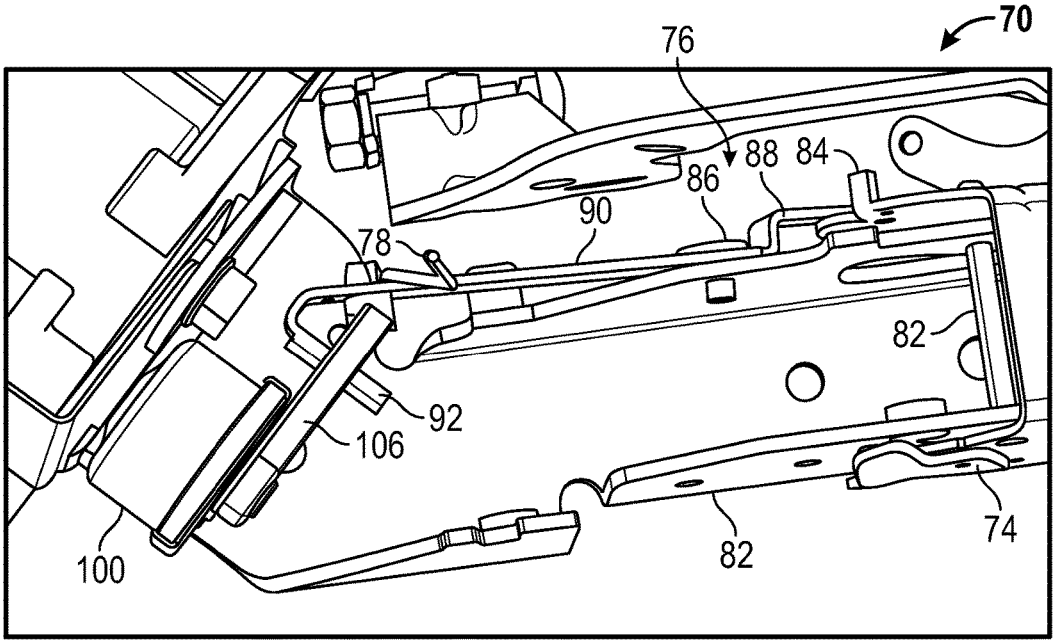
FIG. 7 is a top view of a portion of the override linkage of FIG. 6.

Referring now to FIGS. 5-7, the override linkage 70 includes a first link 72 coupled to the user interface 110; an intermediate bracket 74 coupled to the first link 72, a pivotable lever arm 76, and a second link 78 coupled to the second lever 59 of the choke valve 54.

The first link 72 is a retractable member that translates a user input via the user interface 110 to the intermediate bracket 74 to rotate the intermediate bracket 74. According to an exemplary embodiment, the first link 72 is a Bowden cable. In other exemplary embodiments, the first link 72 may be another mechanical system, such as a network of arms and levers or a pulley system. In other exemplary embodiments, the first link 72 may include an electrical linkage, such as a solenoid or stepper motor coupled by wire or communicating wirelessly to a sensor coupled to the user interface.

The intermediate bracket 74 is disposed below the carburetor 50 and is coupled to a base 80 rigidly attached to the engine 20 (e.g., coupled to cylinder head 24) such that it rotates about an axis 82. The bracket 74 includes a contact surface provided by an extending arm 84. The lever arm 76 is coupled to the base 80 at a pivot point 86 and includes a first end 88 proximate to the intermediate bracket 74 and an opposite, second end 90. The second link 78 couples the second end 90 of the lever arm 76 to the second lever 59 of the choke valve 54. According to an exemplary embodiment, the second link 78 is a rigid rod.

Figure 8A:
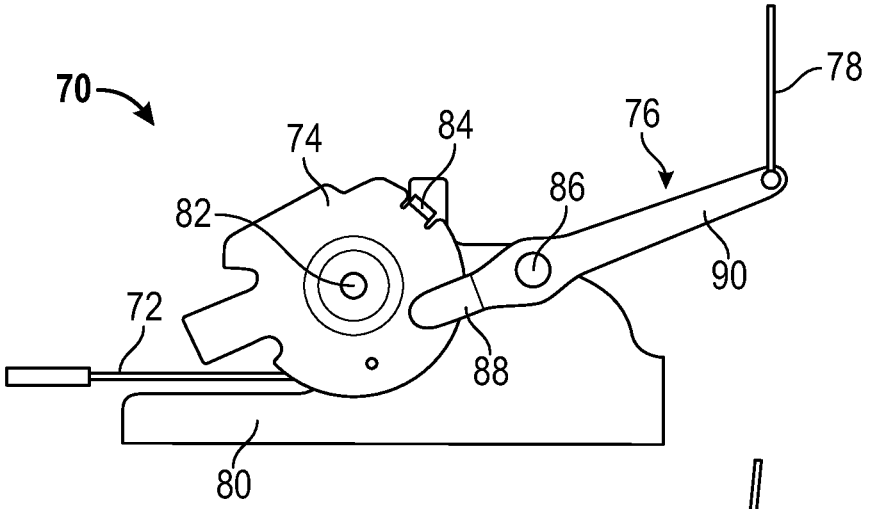
FIG. 8A is a schematic rear view of a portion of an override linkage in a first, disengaged position, in accordance with an exemplary embodiment.
Figure 8B:
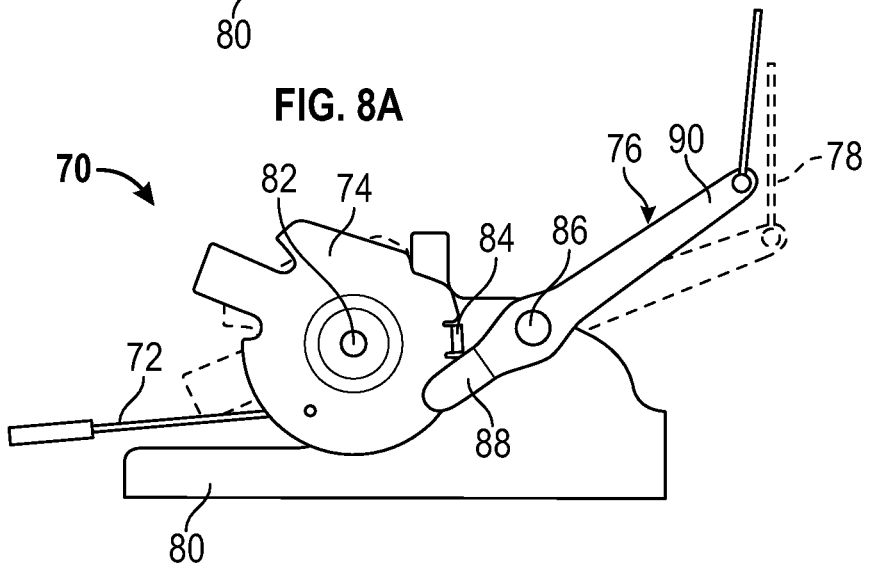
FIG. 8B is a schematic rear view of a portion of an override linkage in a second, engaged position, in accordance with an exemplary embodiment.
Figure 8C:
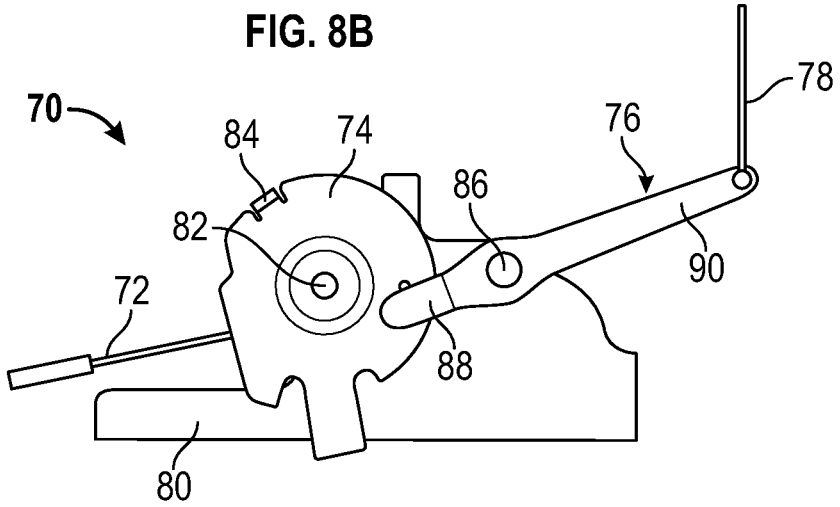
FIG. 8C is a schematic rear view of a portion of an override linkage in a third, disengaged position, in accordance with an exemplary embodiment.

Referring now to FIGS. 8A-8C, the rear of the intermediate bracket 74 is shown in multiple positions. The intermediate bracket 74 is movable between a first position (FIG. 8A) and a second position (FIG. 8B). The first link 72 is coupled to the intermediate bracket 74 such that retraction or extension of the first link 72 rotates the intermediate bracket 74 about the axis 82. Rotation of the intermediate bracket 74 from a first position to a second position causes the arm 84 to abut the first end 88 of the lever arm 76 and rotate the lever arm 76 about the pivot point 86. Rotation of the lever arm 76 about the pivot point 86 causes a movement of the second end 90, which is translated to the second lever 59 by the second link 78 to rotate the choke valve 54 to a closed position.

As described above, the intermediate bracket 74 may be a portion of the throttle control bracket. The first position (e.g., the disengaged position) may therefore be the end of a continuous range, such as the high throttle position. The bracket 74 may therefore be configured to rotate through a larger range than simply from the first position to the second position (e.g., the engaged position). For example, the bracket 74 may have a third position (FIG. 8C) in which the arm 84 is further removed from the first end 88 of the lever arm 76. However, it is only the rotation from the first position to the second position that engages the lever arm 76.

Figure 9:
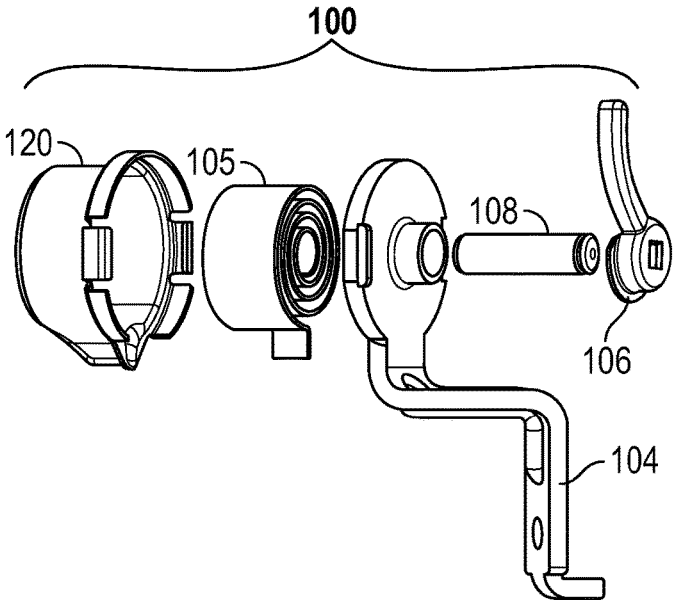
FIG. 9 is an exploded view of a thermostat for use with a choke override system, in accordance with an exemplary embodiment.

Referring to FIG. 9, a thermally responsive member shown as a thermostat 100 is provided. The thermostat 100 is configured to engage the override linkage 70 to retain the choke valve 54 in a partially open position above a threshold temperature.

According to an exemplary embodiment, the thermostat 100 includes a cover 102 and a mounting bracket 104. The cover 102 and mounting bracket 104 define an interior chamber housing a bimetallic coil 105. One end of the bimetallic coil 105 is coupled to the cover while the other end is coupled to a rotating arm 106 through a shaft 108. The thermostat 100 is rigidly mounted to the engine 20 (e.g., to the base 80, directly to the cylinder head 24). The thermostat 100 is positioned such that the arm 106 can contact the second end 90 of the lever arm 76.

As shown in FIG. 5, in one embodiment, the thermostat 100 may be oriented such that the arm 106 is perpendicular to the lever arm 76 of the override linkage 70 and may directly engage the second end 90. In another embodiment, illustrated in FIGS. 6-7, the lever arm 76 may include an angled extension 92 at the distal end of the second end 90. The thermostat 100 may be oriented such that the arm 106 is oblique relative to the lever arm 76 and engages the extension 92. In either embodiment, the arm 106 is not pinned or otherwise permanently coupled to the lever arm 76. Instead, the arm 106 engages the lever arm 76 with a surface to surface contact and only biases the lever arm 76 in one direction (i.e., to partially open the choke valve 54).

Figure 10A:
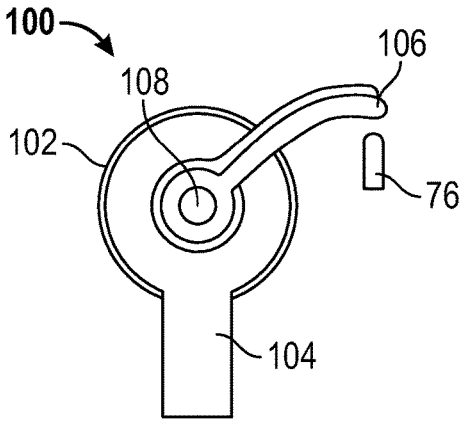
FIG. 10A is a schematic side view of the thermostat of FIG. 9 disengaged from the lever arm, in accordance with an exemplary embodiment.
Figure 10B:
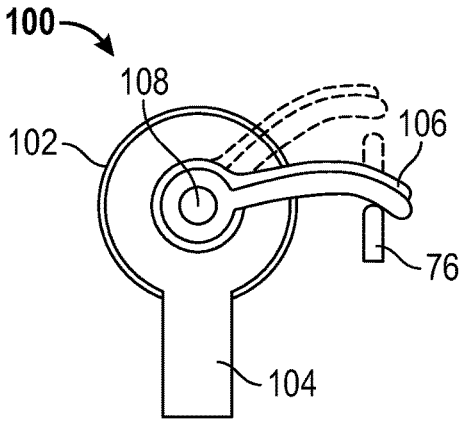
FIG. 10B is a schematic side view of the thermostat of FIG. 9 engaging the lever arm, in accordance with an exemplary embodiment.

As shown in FIG. 10A, at lower temperatures, the thermostat 100 does not contact the lever arm 76. As shown in FIG. 10B, as the engine 20 warms up, the thermostat 100 is heated (e.g., by the exhaust gases, by radiant heat from the engine block, etc.) and the bimetallic coil 105 contracts, winding up tighter and causing the arm 106 to rotate and contact the second end 90 of the lever arm 76 and moving the second link 78 to at least partially open choke valve 54. When the engine 20 is shut off and allowed to cool, the bimetallic coil 105 unwinds, retracting the arm 106 such that it no longer contacts the lever arm 76. In an exemplary embodiment, the thermostat 100 may open the choke valve 54 to a 20% open position (i.e., 80% choke). In other embodiments, the amount the thermostat 100 will open the choke valve may vary depending on the engine type and design. As a result of the partial choke, the air/fuel mixture provided to the engine is leaner than when the choke valve 54 is fully closed. The thermostat 100 therefore acts on the override linkage 70 to facilitate hot restarts of the engine 20 so that an overly enriched air/fuel mixture is not supplied to the engine during a hot restart. An overly enriched air/fuel mixture supplied to the engine when hot may cause stumbling or stalling of the engine and increased noxious exhaust emissions. In an exemplary embodiment, the thermostat 100 is heated by being exposed to the exhaust gasses from the engine 20. In other embodiments, the thermostat may be otherwise heated, such as by an electrically heated element, by radiant heat from the engine block, or by engine coolant transferring heat from the engine block.

While the thermostat 100 is described as having a bimetallic coil, in other embodiments the thermostat may include another thermally responsive devices. For example, in another embodiment, the thermostat may include a bimetallic disk or plate that deforms at a predetermined temperature to engage and actuate a lever arm similar to the arm 106. In another embodiment, the thermostat may include a material that expands when heated to a desired temperature, such as a thermally responsive polymer (e.g., a high density polyethylene, nylon etc.), a wax material, or a gel material. In another embodiment, the thermostat may include a thermally activated electrical switch.

A variety of suitable thermally responsive members are described in U.S. Pat. No. 6,012,420, granted Jan. 11, 2000, and assigned to the Briggs & Stratton Corporation, which is incorporated by reference herein.

Referring now to FIGS. 11A-F, a user interface 110 for the choke override is shown according to several exemplary embodiments. While the thermostat 100 may actuate the override linkage 70 to partially open the choke valve 54, a user may overcome both the thermostat 100 and the air vane linkage 60 utilizing the user interface 110 to selectively engage the choke by closing the choke valve 54. According to an exemplary embodiment, the manual choke override may be integrated into the throttle control and the user interface 110 may be configured to allow for control of both the throttle and selective engagement of the choke.

Figure 11C:
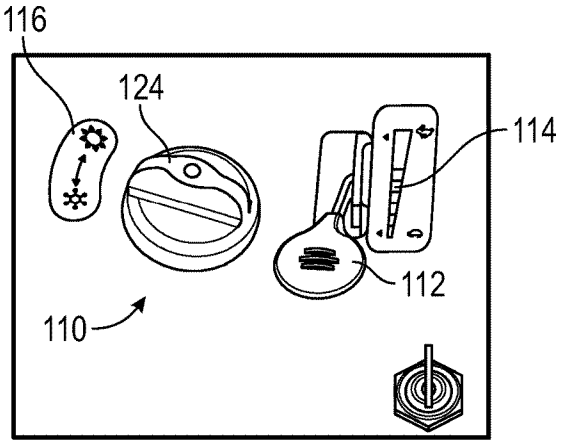
FIGS. 11A-11F are schematic views of a user interface for a choke override system, in accordance with several exemplary embodiments.
Figure 11B:
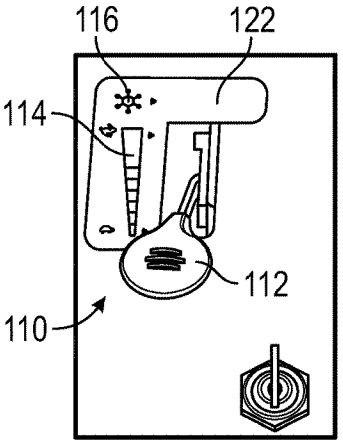
Figure 11A:
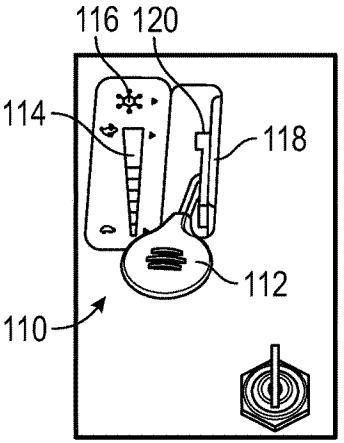

Referring to FIG. 11A, in one embodiment, the user interface 110 may include a throttle lever 112. The user may adjust the throttle by moving the lever 112 up and down. A throttle gauge 114 (e.g., indicia, label, etc.) provides a visual indication of the throttle level. The user may engage the choke by moving the lever 112 past the maximum throttle level to the choke position. The choke position may be indicated with a choke label 116 (e.g., indicator, sticker, label, light, plate, etc.). Because the choke is engaged automatically in warmer temperatures utilizing the air vane 36 and the thermostat 100, the choke label 116 may be configured to convey to the user that the override is intended to be utilized in cold weather conditions. For example, the choke label 116 may be temperature sensitive (e.g., printed using a temperature sensitive ink) and include an icon or label (e.g., a snowflake, an arrow, the word "Start," etc.) that appears when the ambient temperature is below a predetermined threshold to prompt the user to utilize the choke override.

The lever 112 may be configured to reduce the likelihood of an inadvertent engagement of the choke. For example, the lever may be spring-loaded or otherwise biased against a guide 118. The guide 118 may include a mechanical stop 120 (e.g., protrusion, projection, bump, detent, etc.) to provide a tactile indication that the lever 112 is at the maximum throttle position. The user is able to move the lever 112 to the choke position by overcoming the force biasing the lever 112 against the guide 118 to move the lever past the stop 120.

Referring to FIG. 11B, in another embodiment, the user interface 110 may include a panel or cover 122 that prevents the user from moving the lever 112 into the choke position. The cover 122 must be removed or opened to allow the lever 112 to be moved past the maximum throttle position into the choke position.

Figure 11F:
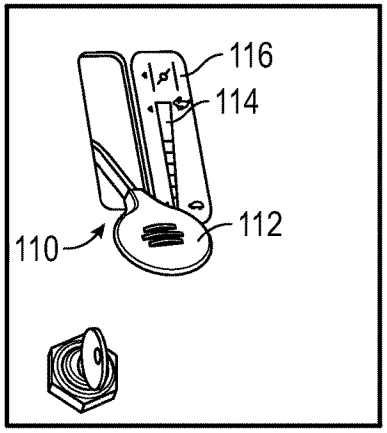
Figure 11E:
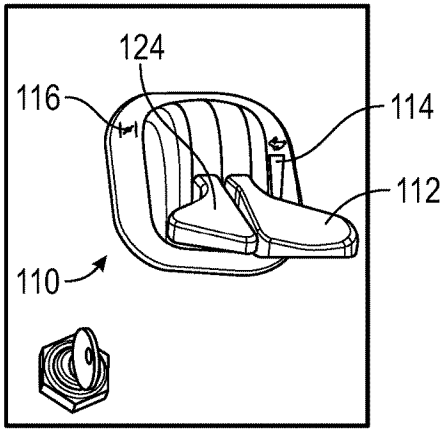
Figure 11D:
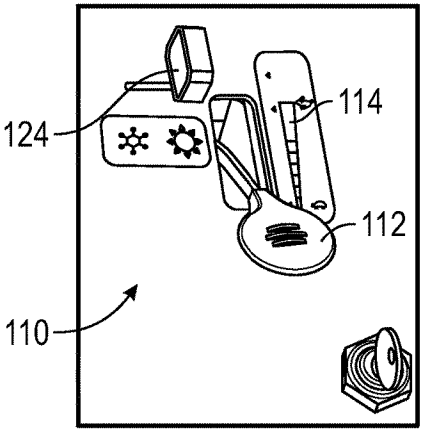

Referring to FIGS. 11C-11E, in another embodiment, the user interface 110 may include a separate apparatus 124 to allow or prevent the choke to be engaged that is independent of the throttle lever 112. For example, the apparatus 124 may be a dial (FIG. 11C), a slider (FIG. 11D), a lever (FIG. 11E) or another suitable input apparatus (e.g., a toggle switch, a pushbutton, etc.).

Referring to FIG. 11F, in other embodiments the user interface 110 may include a lever 112 with a free range of motion from minimum throttle to maximum throttle to the choke position.

In other embodiments, the user interface may include another suitable interlock that must be overcome to engage the choke using the lever, such as a cover over the choke activating apparatus 124.

The manual choke override provides increased reliability and performance for the engine by allowing a user to control the activation of the choke in cold weather environments where an automatic choke system may otherwise disengage the choke prematurely.

Use of both an automatic choke system utilizing the air vane 36 and the thermostat 100 and manual override utilizing the user interface 110 allows the choke to be engaged both at low engine speeds and high engine speeds.

The construction and arrangements of the choke mechanism, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A choke system for an internal combustion engine, comprising:

a carburetor with a choke valve and a throttle valve;

an automatic choke mechanism coupled to the choke valve and configured to automatically operate the choke valve; and an override linkage configured to couple a manually operated control to the choke valve;

wherein the override linkage is operable to manually override the automatic choke mechanism to move the choke valve in a closing direction;

wherein the override linkage is not operable to manually override the automatic choke mechanism to move the choke valve in an opening direction;

wherein the override linkage comprises:

a first link configured to be coupled to the manually operated control;

an intermediate bracket coupled to the first link, the intermediate bracket having a single contact surface;

a pivotable lever arm having a first end and a second end; and a second link coupled between the second end of the lever arm and the choke valve;

wherein the intermediate bracket is rotatable about an axis by the first link between a first position and a second position;

wherein rotation of the intermediate bracket from the first position to the second position causes the single contact surface to abut the first end of the lever arm to rotate the lever arm to move the second end of the lever arm and the second link, thereby moving the choke valve in the closing direction; and wherein rotation of the intermediate bracket from the second position to the first position causes the single contact surface to move out of abutment with the first end of the lever arm so that the automatic choke mechanism is allowed to operate the choke valve.

2. The choke system for an internal combustion engine of claim 1, wherein the automatic choke mechanism comprises:

a radial fan configured to create a variable air flow dependent on the speed of the engine;

an air vane moveable in response to the variable air flow; and an air vane linkage coupling the air vane to the choke valve, the air vane linkage operating the choke valve by the movement of the air vane.

3. The choke system for an internal combustion engine of claim 1, further comprising a thermally responsive member configured to contact the override linkage to retain the choke valve in a partially open position by preventing the choke valve from moving toward the closed position when the thermally responsive member is heated above a threshold temperature.

4. The choke system for an internal combustion engine of claim 1, further comprising:

a manually operated control comprising:

a single lever having a throttle range and a choke position;

a structure to prevent the inadvertent positioning of the single lever in the choke position; and an indicator for the choke position of the single lever.

5. The choke system for an internal combustion engine of claim 4, wherein the indicator is a temperature sensitive label.

6. The choke system of claim 3, where the override linkage is operable to manually override the thermally responsive member to move the choke valve in a closing direction; and wherein the override linkage is not operable to manually override the thermally responsive member to move the choke valve in an opening direction.

7. The choke system of claim 6, wherein the thermally responsive member contacts the second end of the lever arm when the thermally responsive member is heated above the threshold temperature.

8. The choke system of claim 7, wherein the thermally responsive member comprises a bimetallic coil.

9. The apparatus of claim 8, wherein manipulation of the first link of the override linkage overcomes the force applied to the lever arm of the override linkage by the thermally responsive member.

10. The choke system of claim 9, wherein the lever arm does not contact the intermediate bracket when the thermally responsive member contacts the lever arm and the intermediate bracket is in the first position.

11. The choke system of claim 1, wherein the intermediate bracket rotates about an axis to move from the first position to the second position.

12. The choke system of claim 1, wherein the first link comprises a Bowden cable.

13. The choke system of claim 2, further comprising a biasing member configured to bias the air vane linkage to close the choke valve.

14. The choke system of claim 6, wherein the automatic choke mechanism comprises a solenoid coupled to the choke valve.

15. The choke system of claim 1, wherein the automatic choke mechanism comprises a solenoid coupled to the choke valve.

* * * * *